US007848087B2

(12) United States Patent
Huang

(10) Patent No.: US 7,848,087 B2
(45) Date of Patent: Dec. 7, 2010

(54) ELECTRONIC DEVICE

(75) Inventor: Chih-Chien Huang, Tu-Cheng (TW)

(73) Assignee: Chi Mei Communication Systems, Inc., Tu-Cheng, Taipei County (TW)

( * ) Notice: Subject to any disclaimer, the term of this patent is extended or adjusted under 35 U.S.C. 154(b) by 78 days.

(21) Appl. No.: 12/342,885

(22) Filed: Dec. 23, 2008

(65) Prior Publication Data

US 2009/0262490 A1 Oct. 22, 2009

(30) Foreign Application Priority Data

Apr. 22, 2008 (CN) ..... 2008 1 0301244

(51) Int. Cl.
*H05K 7/12* (2006.01)

(52) U.S. Cl. ..... 361/679.02; 361/679.56; 361/679.55; 455/575.1

(58) Field of Classification Search ..... 361/679.01, 361/679.02, 679.55, 679.56; 455/575.1–575.4; 379/433.11–433.13
See application file for complete search history.

(56) References Cited

U.S. PATENT DOCUMENTS 5,724,667 A * 3/1998 Furuno ..... 455/575.2
7,032,728 B2 * 4/2006 Harcourt ..... 191/12.2 R
2003/0008550 A1 * 1/2003 Tse et al. ..... 439/501
2005/0041059 A1 * 2/2005 Nakashima et al. ..... 347/29
2005/0220316 A1 * 10/2005 Hsiang ..... 381/315
2005/0255898 A1 * 11/2005 Huang ..... 455/575.8

FOREIGN PATENT DOCUMENTS

JP 04014323 A * 1/1992

* cited by examiner

*Primary Examiner*—Jayprakash N Gandhi
*Assistant Examiner*—Ingrid Wright
(74) *Attorney, Agent, or Firm*—D. Austin Bonderer

(57) ABSTRACT

An electronic device is described. The electronic device includes a housing, a printed circuit board mounted in the housing, an earphone and a retracting mechanism. The earphone includes a connecting cable and a head member. One end of the connecting cable is connected to the printed circuit board, the other is connected to the head member. The retracting mechanism includes a receiving compartment and a receiving space communicating with the receiving compartment. The receiving compartment receives the connecting cable therein. The head member is received in and fixed to the receiving space.

5 Claims, 6 Drawing Sheets

ELECTRONIC DEVICE

BACKGROUND

1. Field of the Invention

The present invention relates to an electronic device and, particularly, to an electronic device incorporating a retractable earphone.

2. Description of Related Art

Usually, earphones are used to listen to music in portable electronic devices (e.g., MP3 players). However, earphones typically have long connecting cables and the connecting cables easily get tangled. Additionally, when the earphone is detached from the electronic device, the earphone may be lost or misplaced.

Therefore, there is room for improvement within the art.

BRIEF DESCRIPTION OF THE DRAWINGS

Many aspects of the electronic device can be better understood with reference to the following drawings. These drawings are not necessarily drawn to scale, the emphasis instead being placed upon clearly illustrating the principles of the present electronic device. Moreover, in the drawings like reference numerals designate corresponding sections throughout the several views.

DETAILED DESCRIPTION OF EXEMPLARY EMBODIMENTS

Figure 1:
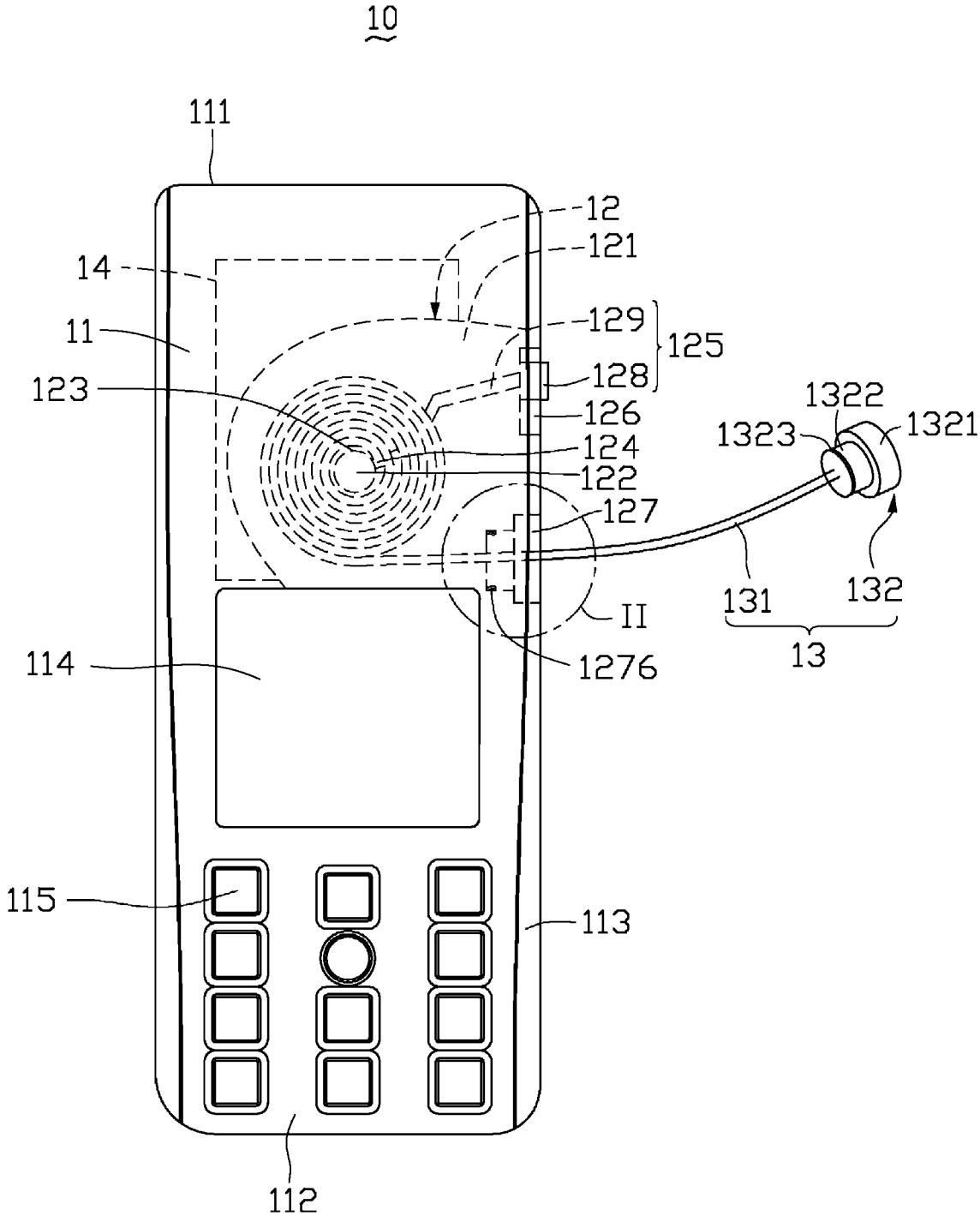
FIG. 1 is a front view of an electronic device, in accordance with a first exemplary embodiment.
Figure 2:
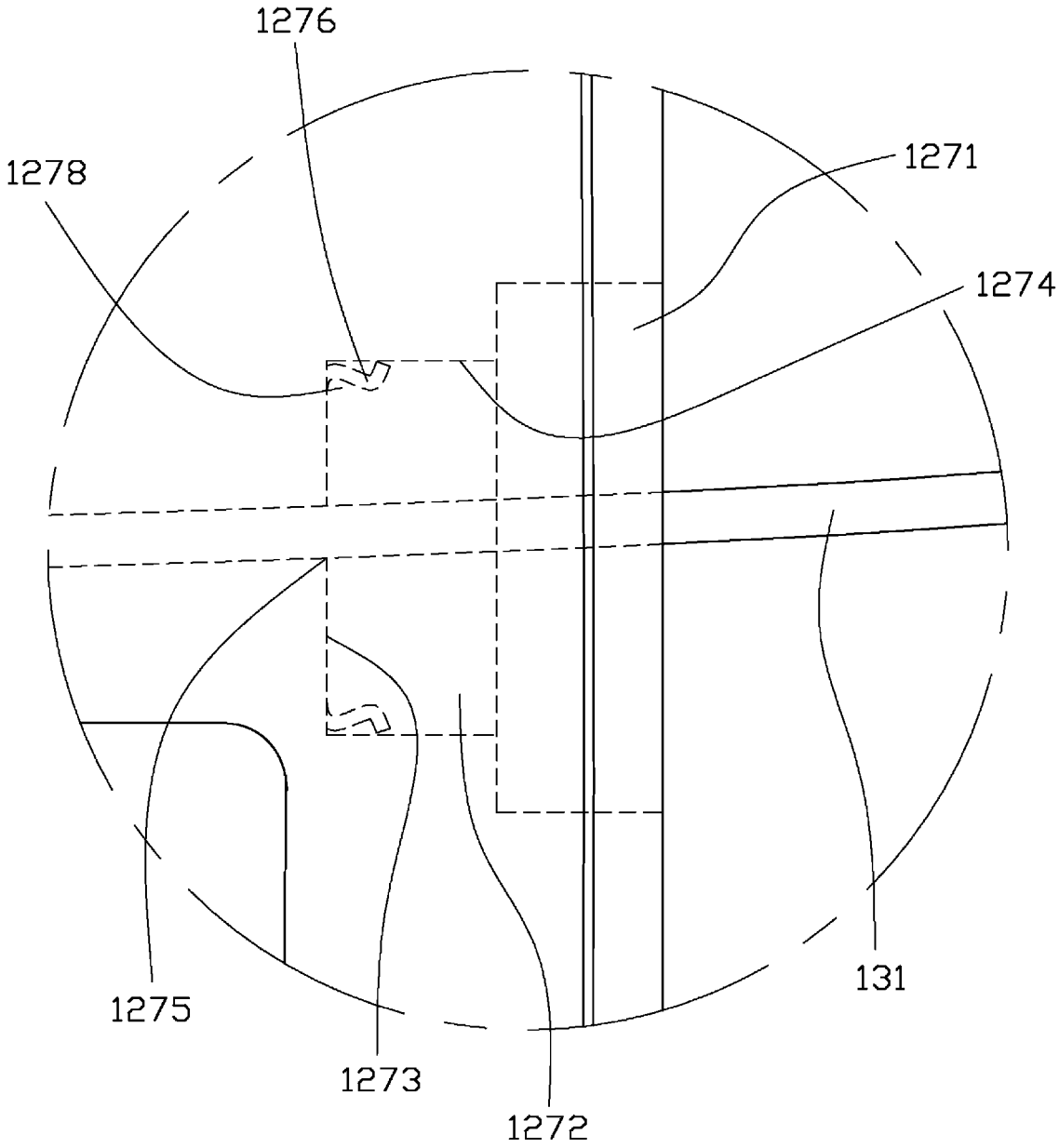
FIG. 2 is a partially enlarged view of the receiving cavity shown in FIG. 1.
Figure 3:
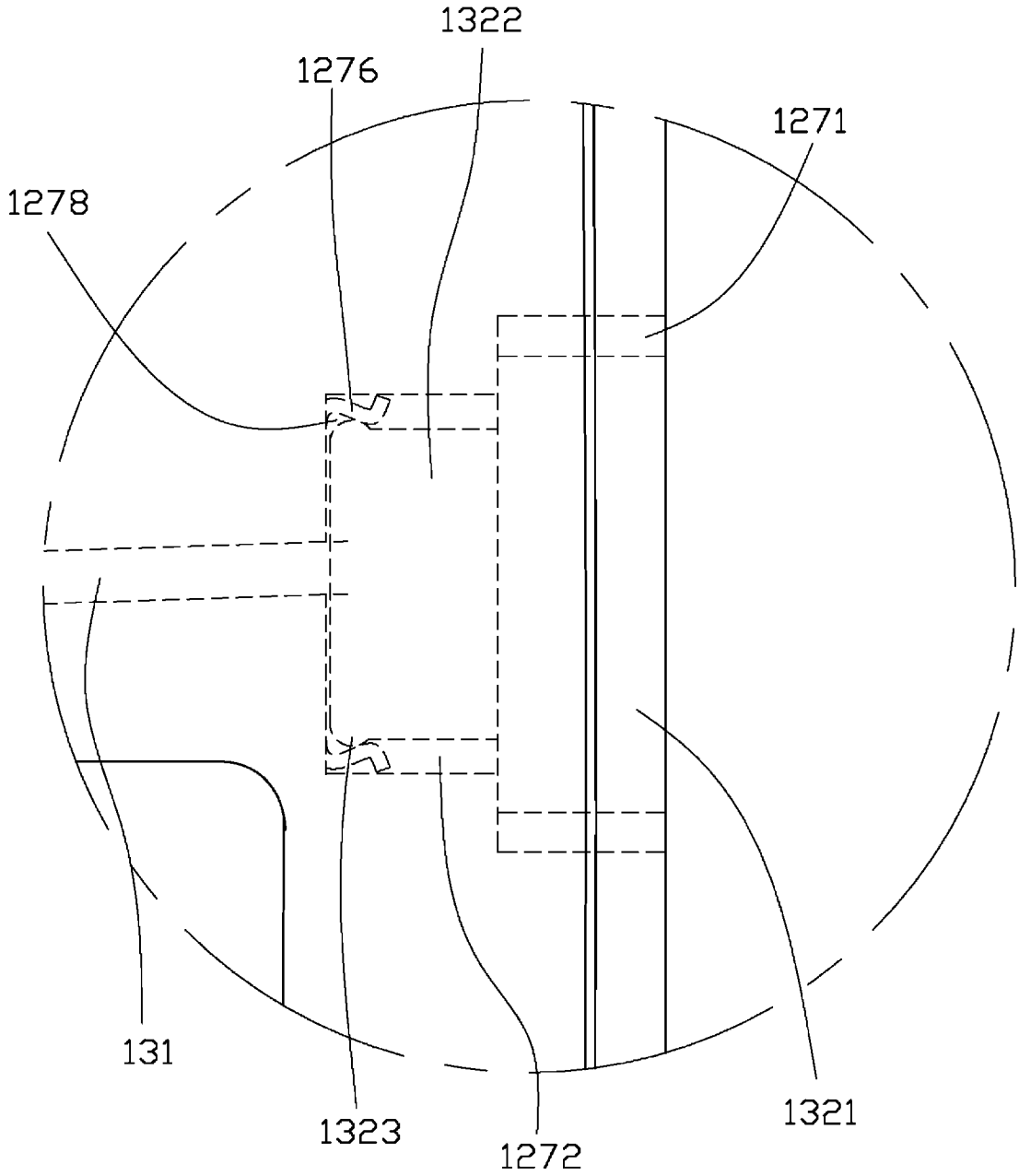
FIG. 3 is a partially enlarged view of the receiving cavity incorporating the earphone shown in FIG. 2.

FIGS. 1 and 2 show a first exemplary electronic device 10 including a housing 11, a printed circuit board (PCB) 14, a retracting mechanism 12 and an earphone 13 with a connecting cable 131 and a head member 132. One end of the connecting cable 131 is electrically connected to the PCB 14 and the other end connected to the head member 132. The PCB 14 and the retracting mechanism 12 are mounted within the housing 11. The earphone 13 can be electrically connected to the PCB 14.

The housing 11 includes a top portion 111, a bottom portion 112 and a peripheral wall 113. The housing 11 includes a screen 114 adjacent to the top portion 111 and a plurality of keys 115 adjacent to the bottom portion 112.

The retracting mechanism 12 retracts the earphone 13 and its connecting cable 131 into the housing 11 and includes a receiving compartment 121, a shaft portion 122, a spool 123, a torsion spring 124, a button 125, a button cavity 126 and a receiving space 127.

The receiving compartment 121 receives the connecting cable 131 of the earphone 13. The shaft portion 122 is secured to the housing 11. The spool 123 is rotatably mounted around the shaft portion 122. One end of the torsion spring 124 is fixed to the shaft portion 122, the other end of the torsion spring 124 is fixed to the spool 123. The spool 123 rotates about the shaft portion 122. The button cavity 126 is defined in the peripheral wall 113 communicating with the receiving compartment 121. The button 125, forms a latching member and includes a controlling portion 128 and a resisting portion 129 connecting to the controlling portion 128. The controlling portion 128 is slidably mounted in the button cavity 126. Although not shown in the FIGS. due to being under the coiled connecting cable 131, the resisting portion 129 abuts against the periphery of the spool 123.

The receiving space 127 is defined in the peripheral wall 113 adjacent to the button cavity 126 and communicates with the receiving compartment 121. The receiving space 127 has a T-shaped cross-section including a first receiving section 1271 and a second receiving section 1272 communicating with the first receiving section 1271. The second receiving section 1272 is defined by a wall 1273 and a peripheral wall 1274. The bottom wall 1273 defines a hole 1275. Two opposite elastic sheets 1276 are respectively secured to opposite corners between the peripheral wall 1274 and the bottom wall 1273 in the second receiving section 1272. The elastic sheets 1276 form two latching slots 1278 facing each other.

The connecting cable 131 is configured to coil about the spool 123. The head member 132 can be secured in the receiving space 127. The head member 132 is generally T-shaped including a sound portion 1321 and a connecting portion 1322. The sound portion 1321 is configured to be received in the first receiving section 1271. The connecting portion 1322 is configured to be received in the second receiving section 1272. A latching block 1323 is formed on the peripheral wall of the connecting portion 1322 distal to the sound portion 1321. The latching block 1323 secures into the latching slot 1278.

To use the earphone 13, e.g., listen to music, the button 125 is pulled away from the spool 123, so that the resisting portion 19 of the button 125 no longer applies a friction force to the spool 123. Then the head member 132 of the earphone 13 is pulled from the receiving space 127 and the connecting cable 131 of the earphone 13 is pulled from the housing 11, unwinding from the spool 123. The torsion spring 124 accumulates a torsional force as the spool 123 rotates to unwind the connecting cable 131. When the connecting cable 131 of the earphone 13 is pulled out a desired amount from the housing 11, the button 125 is pressed towards the spool 123 to apply a friction force to the spool 123 again, so that the spool 123 doesn't roll about the shaft portion 122. At this time, the friction force between the resisting portion 129 and the spool 123 is equal to the torsion force of the torsion spring 124. Accordingly, a user can easily put the head member 132 of the earphone 13 into his/her ears for listening to music.

To use the retracting mechanism 12 to retract the connecting cable 131 into the housing 11, the button 125 is pulled away from the spool 123, removing the friction force between the resisting portion 129 and the spool 123. In this case, the torsion spring 124 drives the spool 123 to rotate reversely about the shaft portion 122. Thus, the connecting cable 131 rewinds about the spool 123 and is received in the the receiving compartment 121 again as the spool 123 rotates about the shaft portion 122. At this time, the head member 132 is re-secured into the receiving space 127 by the latching of the latching block 1323 into the latching slot 1278.

Figure 4:
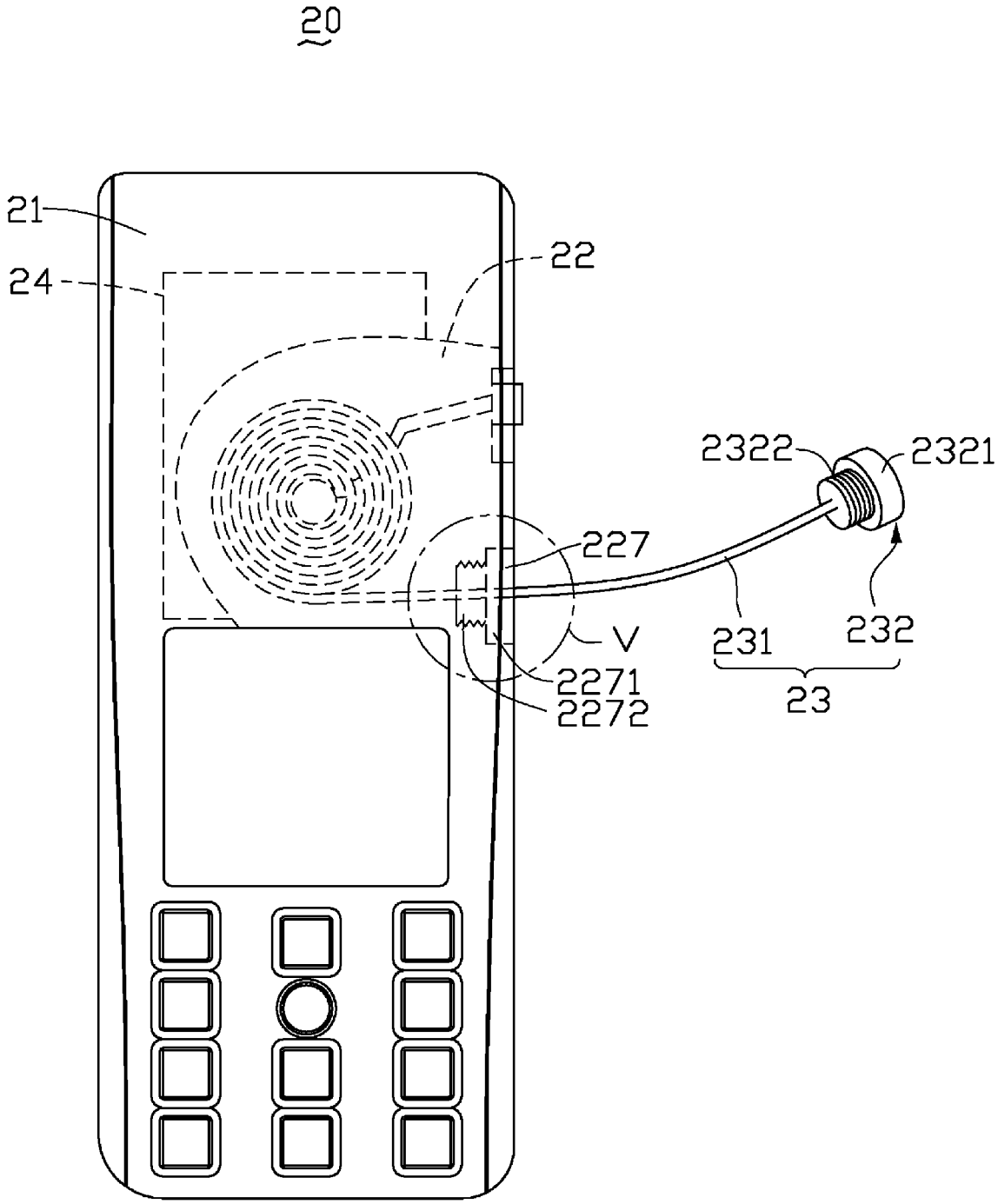
FIG. 4 is a front view of an electronic device, in accordance with a second exemplary embodiment.
Figure 5:
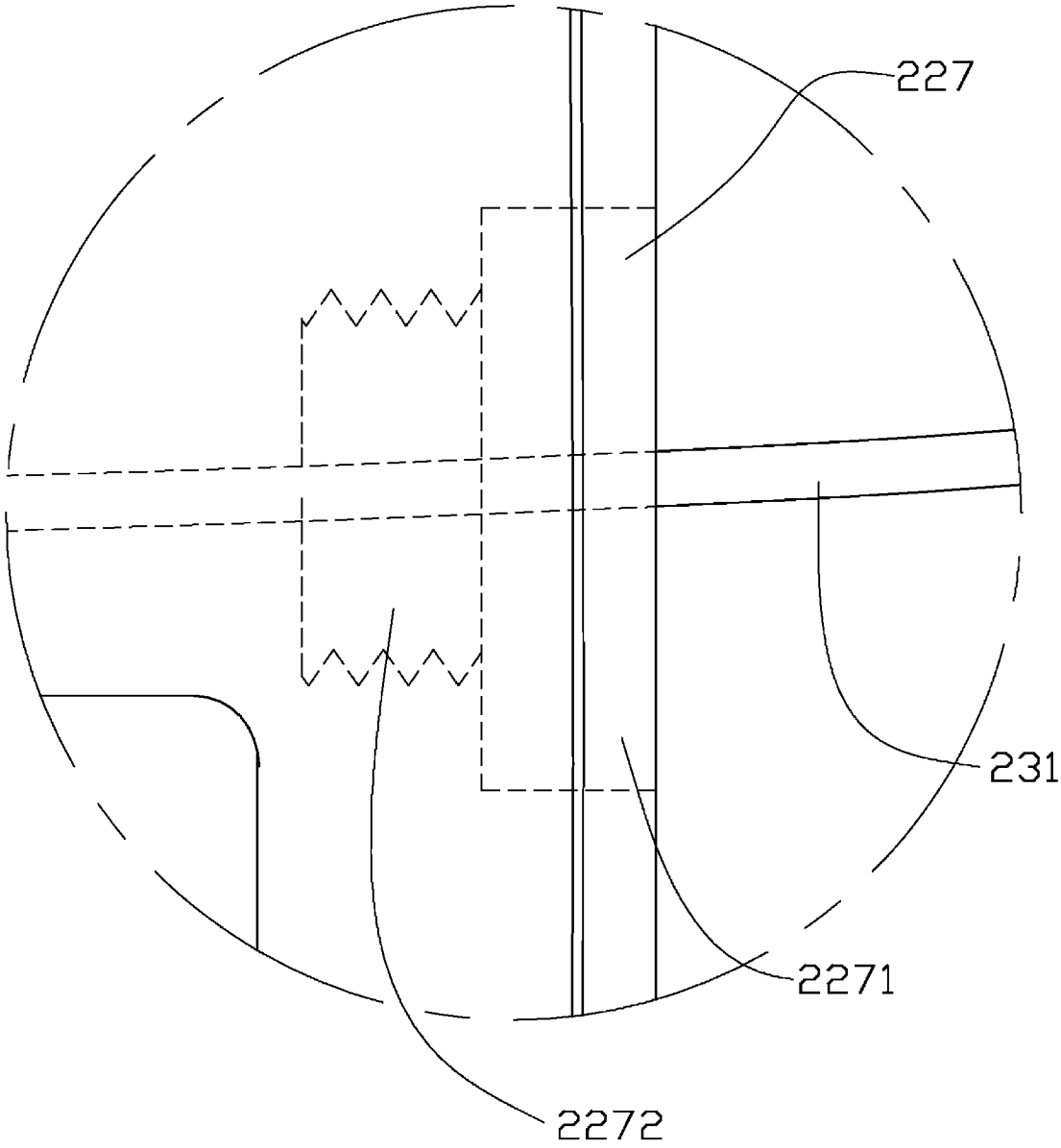
FIG. 5 is a partially enlarged view of the receiving cavity shown in FIG. 4.
Figure 6:
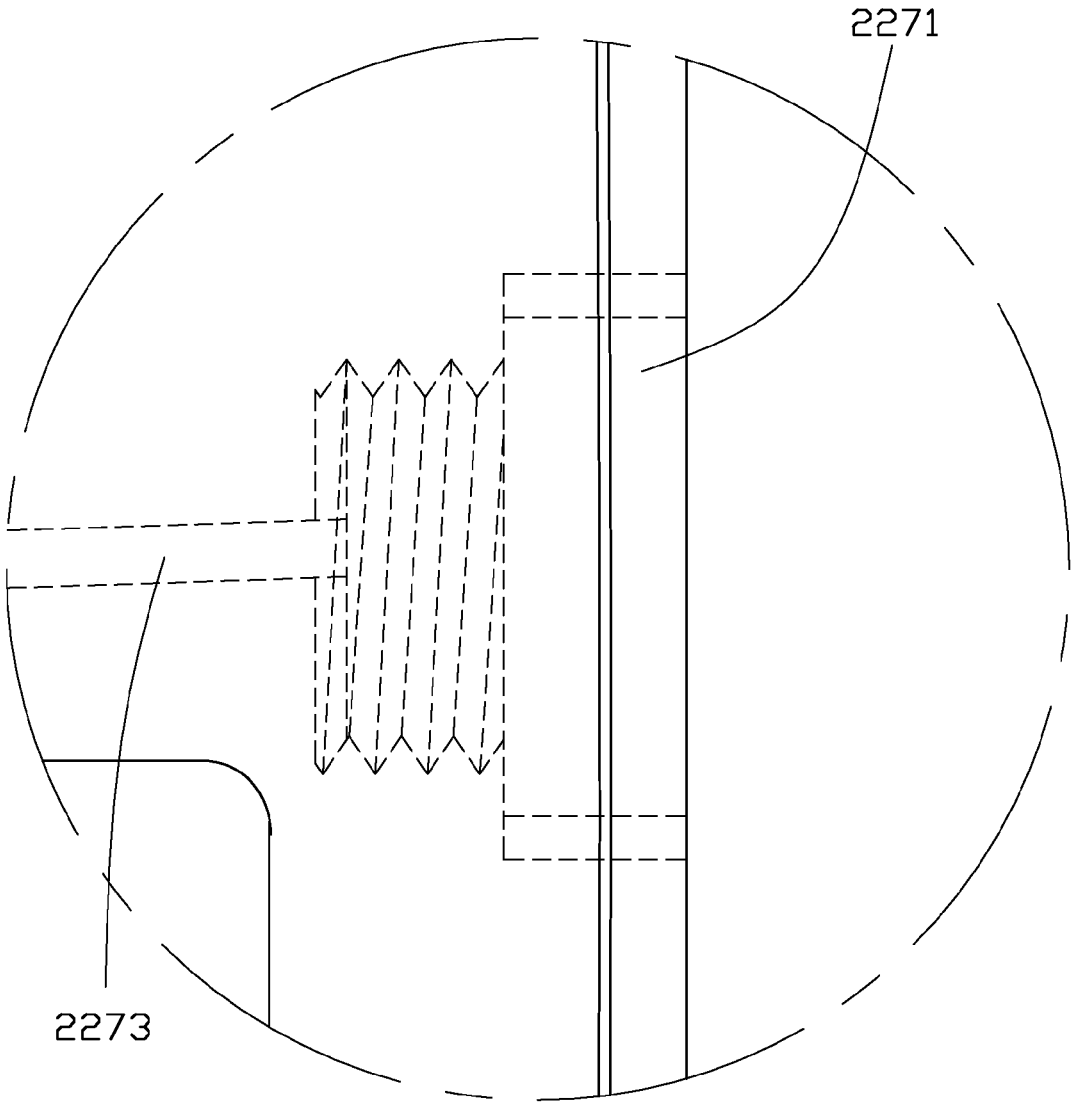
FIG. 6 is a partially enlarged view of the receiving cavity incorporating the earphone shown in FIG. 5.

Referring to FIGS. 4 through 6, a second exemplary electronic device 20 is shown. The electronic device 20 is similar to the electronic device 10 and includes a housing 21, a PCB 24, a retracting mechanism 22 and an earphone 23. The PCB 24 and the retracting mechanism 22 are mounted within the housing 21. The housing 21 defines a receiving space 227. The receiving space 227 includes a first receiving section 2271 and a second receiving section 2272. The second receiving section 2272 has a plurality of threads formed on an inner wall. The earphone 23 is electrically connected to the PCB 24, and includes a connecting cable 231 and a head member 232. The head member 232 is generally T-shaped and includes a sound portion 2321 and a connecting portion 2322. The connecting portion 2322 has a plurality of threads formed on an outer peripheral wall. The difference between the electronic device 20 and the electronic device 10 is that the earphone 23 is threadingly secured into the second receiving section 2272.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of sections within the principles of the invention to the full extent indicated by the broad general meaning of the terms, in which the appended claims are expressed.

What is claimed is:

1. An electronic device having a retractable earphone, comprising:

a housing;

a printed circuit board mounted within the housing;

an earphone including a connecting cable and a head member, one end of the connecting cable connected to the printed circuit board, the other connected to the head member; and a retracting mechanism comprising a shaft portion, a spool, a torsion spring, and a latching member, the torsion spring having one end connected to the spool and the other end connected to the shaft portion;

wherein, the connecting cable unwinds from the spool when the earphone is extended from the housing to an extended position, the connecting cable winds around the spool when the earphone is refracted into the housing to a retracted position;

the latching member disengaging from the spool during transfer of the earphone between the extended position and the retracted position, and engaging with the spool to maintain the earphone in the extended position and the retracted position; and the torsion spring releasing a torsion force to automatically drive the earphone to move from the extended position to the retracted position when the latching member disengages from the spool, wherein the latching member is a button including a controlling portion and a resisting portion, the resisting portion connected to the controlling portion, the controlling portion being slidably mounted to the housing and pulled away from the housing when the latching member disengages from the spool, the resisting portion abutting against the spool and applying a friction force to bias the spool against rotating.

2. The electronic device as claimed in claim 1, wherein the spool is rotatably mounted around the shaft portion, the shaft portion is mounted on the housing, the torsion spring driving the spool to rotate about the shaft portion when the connecting cable unwinds from the spool.

3. The electronic device as claimed in claim 1, wherein an elastic sheet protrudes from a peripheral wall of the receiving space, the elastic sheet forming a latching slot.

4. The electronic device as claimed in claim 3, wherein a corresponding latching block protrudes from the peripheral wall of the head member, the latching block being secured into the latching slot.

5. The electronic device as claimed in claim 1, wherein the head member is threadingly secured to the receiving space.

* * * * *